United States Patent [19]

Klyen

[11] 3,986,553

[45] Oct. 19, 1976

[54] FLUID SAMPLING VESSEL

[75] Inventor: Lewis Ernest Klyen, Taupo, New Zealand

[73] Assignee: New Zealand Inventions Development Authority, Wellington, New Zealand

[22] Filed: Jan. 7, 1975

[21] Appl. No.: 539,211

[30] Foreign Application Priority Data

Jan. 8, 1974 New Zealand ..... 173058

[52] U.S. Cl. ..... 166/164; 166/169; 166/264; 73/425.4 R

[51] Int. Cl.[2] ..... E21B 43/00; E21B 47/00

[58] Field of Search ..... 166/264, 164, 165–169; 73/425, 425.2, 425.4 R, 155

[56] References Cited

UNITED STATES PATENTS

| | | | |
|---|---|---|---|
| 2,176,240 | 10/1939 | Bandy | 166/164 |
| 2,308,156 | 1/1943 | Crump | 166/164 |
| 2,316,216 | 4/1943 | Bandy | 166/164 |
| 2,364,464 | 12/1944 | Moore | 166/164 X |
| 2,492,694 | 12/1949 | Graham, Jr. | 166/164 |
| 2,623,594 | 12/1952 | Sewell | 166/164 X |
| 2,707,520 | 5/1955 | Jordan | 166/164 X |
| 2,982,360 | 5/1961 | Morton et al. | 166/242 |
| 3,047,072 | 7/1962 | Peters et al. | 166/164 |
| 3,075,585 | 1/1963 | Carlton et al. | 166/164 |
| 3,412,607 | 11/1968 | Jensen | 166/264 X |

*Primary Examiner*—Stephen J. Novosad
*Attorney, Agent, or Firm*—Ladas, Parry, Von Gehr, Goldsmith & Deschamps

[57] ABSTRACT

A sampling vessel, adpated particularly for use in geothermal bores, constructed principally of stainless steel and opened at depth without ancillary means such as messengers by causing an inertial mechanism to break a frangible seal.

3 Claims, 19 Drawing Figures

FLUID SAMPLING VESSEL

Figure 1:
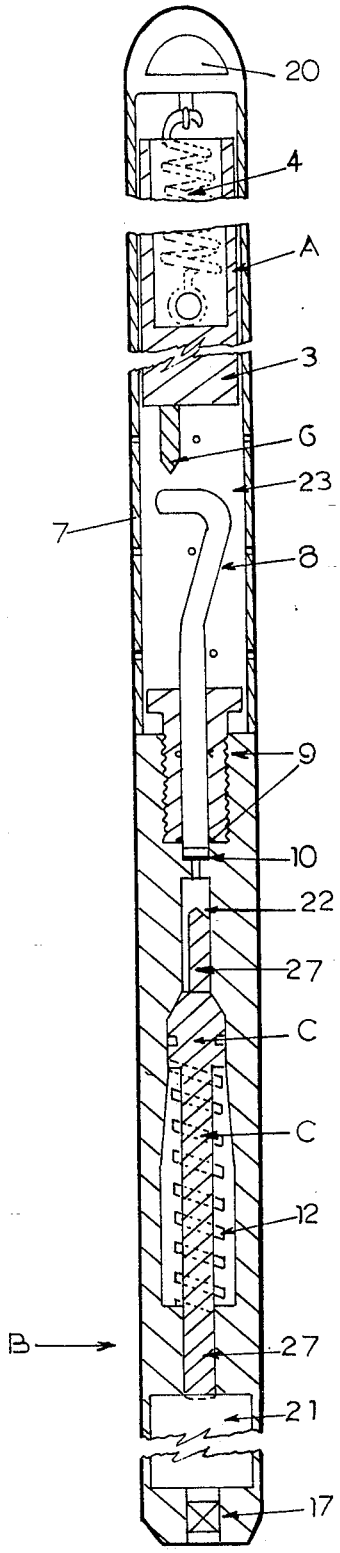

This invention relates to a sampling vessel, in particular but not solely to a vessel for obtaining samples of fluid (liquid or gas) at depth from a bore hole in a geothermal field. The vessel may also be used for obtaining samples of fluid from a bore hole in an oil or salt field or for obtaining samples at depth of river, lake or sea water. Since the conditions of use are most rigorous in a geothermal field, this is the environment for which the embodiment to be described was designed.

In assessing the potential of a geothermal field that is being explored holes are drilled and measurements, both physical and chemical, are made. For the chemical measurements samples must be obtained of the fluids, which may be either gas or liquid, either delivered by or contained in the bore hole. The simplest place at which to take samples is at the surface but by the time the fluids have travelled up the well they have changed in a variety of ways for which it is difficult to make allowance, and they are not directly relatable to the rock mineralogy, temperature and pressure at their point of origin. Especially when there is more than one production level in the drilled depth of a hole, surface chemistry does not give sufficient information to delineate the chemical gradient in the hole, and to extend reservoir information to maximum drilled depths, the use of a down hole sample vessel is required.

Existing designs of down hole sample vessels fall broadly into two categories:

1. Bottles initially open, closing after sampling,
2. Bottles remaining closed during descent and ascent, opening only for sample collection.

Faults found in existing types of bottle are:

a. Uncertainty of time of sealing, and so of the depth at which the sample was obtained.

b. Uncertainty whether the seal remained intact during the bottle retrieval.

c. Failure to withstand extreme down hole conditions.

Mechanisms incorporating non-return valves with unsecured ball seals are vulnerable to faults a and b. Mechanisms operated by clockwork and those incorporating many dynamic O-ring seals are vulnerable to fault c.

One early design in category 1 had pre-loaded taper valves at either end of the sample vessel. They were closed and so secured the sample, upon the impact of a go-devil released down the suspension wire. This design was complex and costly. A second design (Fournier R. O. and Morgenstern J. C. (1971): "A Device for Collecting Down Hole Water and Gas Samples in Geothermal Wells" U.S. Geol. Survey Prof. Paper 750-C, C151–155) has a gas operated valve system. Gas under pressure is transferred from the surface to the valves of the sample vessel through a small-bore stainless steel capillary tube which serves also as a suspension wire.

The conditions in bore holes in New Zealand geothermal fields include:

1. Temperature up to 300° C.
2. Pressure up to 230 atm. (Hypothetical pressure if deepest Wairakei (New Zealand) Bore was full of cold water).
3. Solution pH 4 to 9
4. Salinity 100 to 5,000 mg/kg.
5. Operating depth to 2,200 m.

Local conditions and experience with previous designs suggest that the following points should be taken into account:

1. The design should be such that lowering and raising the bottle may be carried out by a standard well measurement winch.
2. The vessel should be mechanically self-contained, that is without triggering go-devils or messengers which have problems of friction and differing weight to impact ratios in media of varying densities.
3. Clockwork mechanisms should be avoided due to their high servicing and slow turn around requirements.
4. Dynamic O-ring seals do not tolerate the environment well and their number should be kept to the minimum.

For ease of handling, consistent with normal well head equipment, the vessel's maximum dimensions for use in production wells were specified to be:

1. Sampling volume 500–600 $cm^3$
2. Length 1.8 m
3. Outside diameter 50 mm
4. Weight 11 Kg In initial surveys samples may be taken from cooler, shallower, boreholes 15 – 30 mm in diameter. A second form of the sampling vessel has been produced for conditions which include:

1. Temperature up to 100°
2. Pressure up to 14 atm.
3. Operating depth to 140 m.

A suitable vessel can have as dimensions:

1. Sampling volume 30 – 33.5 $cm^3$
2. Length 573 mm
3. Outside diameter 12.7 mm
4. Weight 248 g.

The length, and so the sampling volume, may be increased for bore holes that are straight and vertical.

It is an object of the present invention to provide sampling vessels which will meet the abovementioned requirements and avoid the difficulties heretofore encountered or will at least provide the public with a useful choice.

Accordingly, the invention may be said to consist in a sampling vessel adapted for lowering into bodies of fluids wherein the entry of fluids during lowering is prevented by a frangible seal, which seal may be broken by mechanical manipulation of the means which support the vessel at a depth and a time which may be selected.

The invention consists in the foregoing and also envisages constructions of which the following gives examples only.

Figure 2:
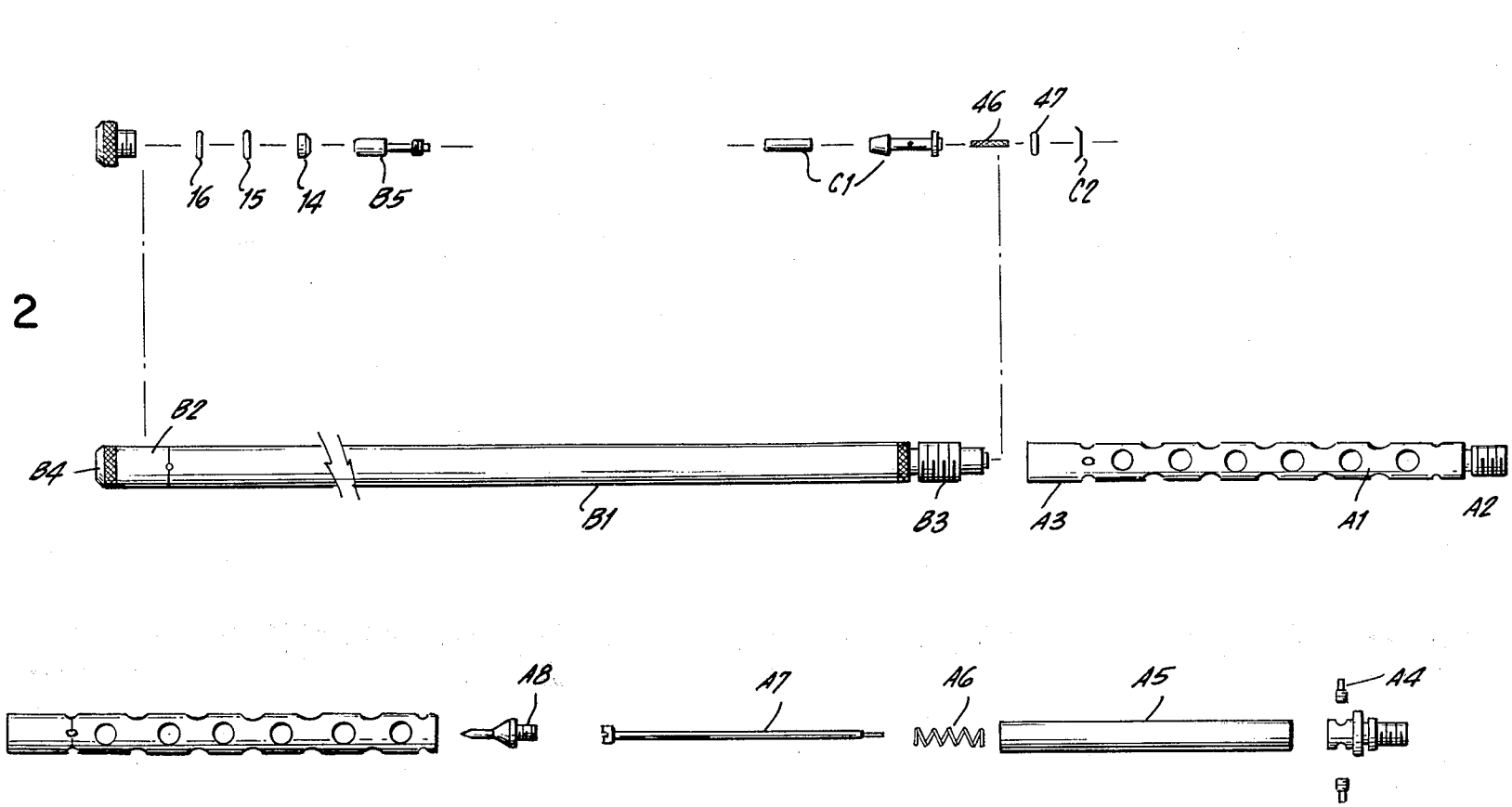

Two preferred forms of the invention will now be described in relation to the accompanying drawings in which:

FIG. 1 shows in section a sampling vessel adapted to be used in a production bore hole, FIG. 2 is a schematic outlined drawing, partly assembled and partly exploded, of a sampling vessel adapted to be used in a narrow bore hole. On it a number of parts are distinguished by letters and figures, the remaining figures show these parts in detail.

Figure 3:
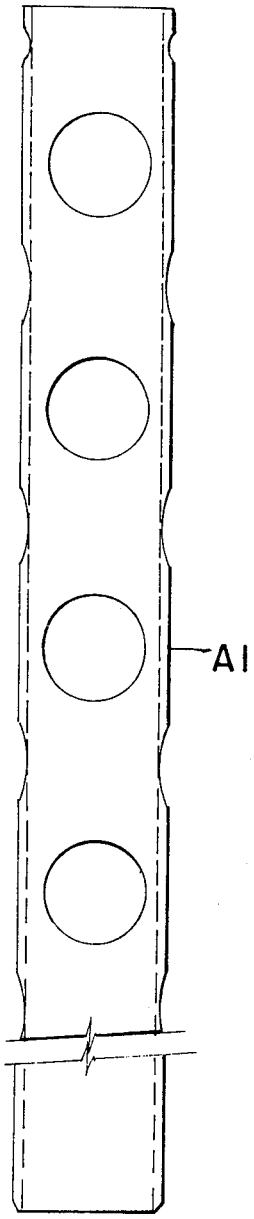
Figure 4:
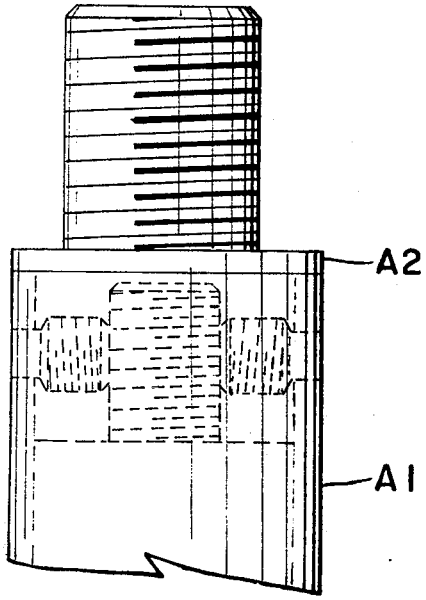
Figure 5:
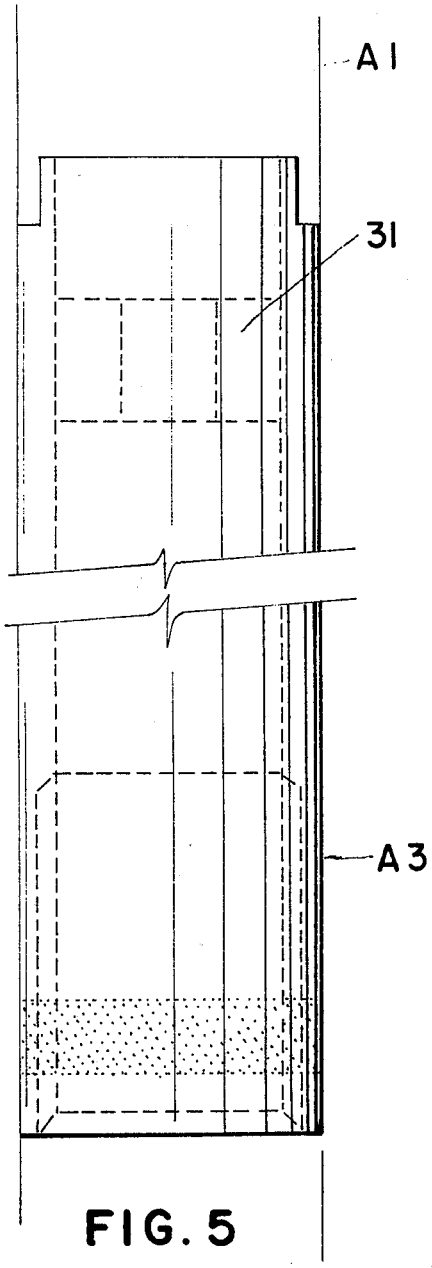
Figure 7:
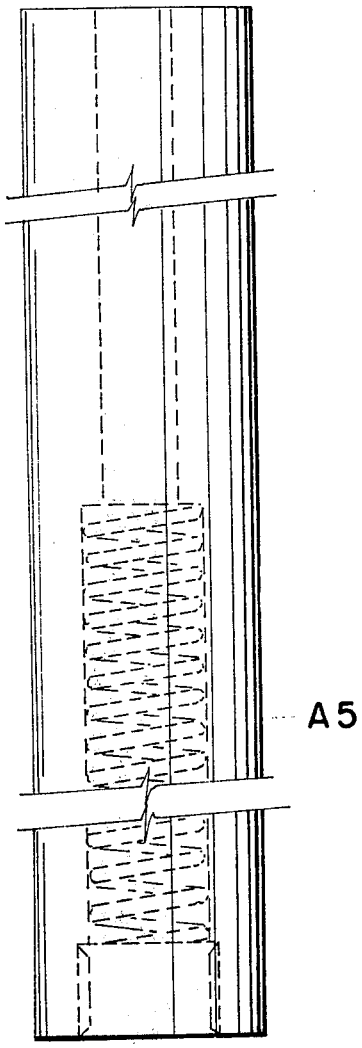
Figure 6:
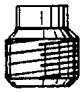

| FIG. 3 – FIG. 18 | NAME OF PART | LABEL OF PART |
|---|---|---|
| FIG. 3 | Upper Barrel | A1 |
| FIG. 4 | Head of Upper Barrel | A2 |
| FIG. 5 | Foot of Upper Barrel | A3 |
| FIG. 6 | Grub screw | A4 |
| FIG. 7 | Inertia weight | A5 |

-continued

Figure 8:
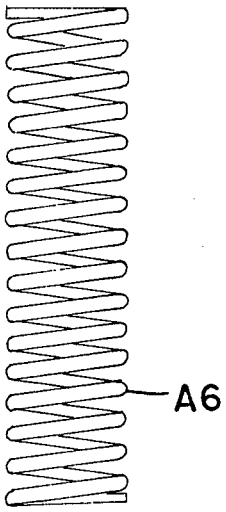
Figure 9:
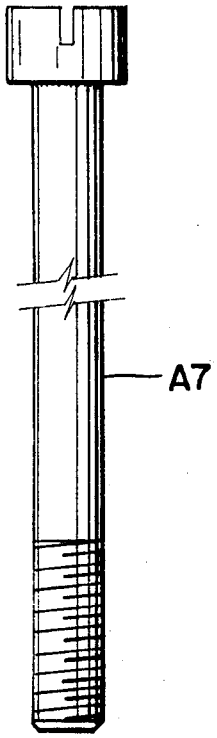
Figure 10:
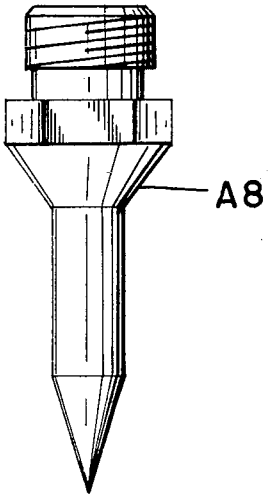
Figure 11:
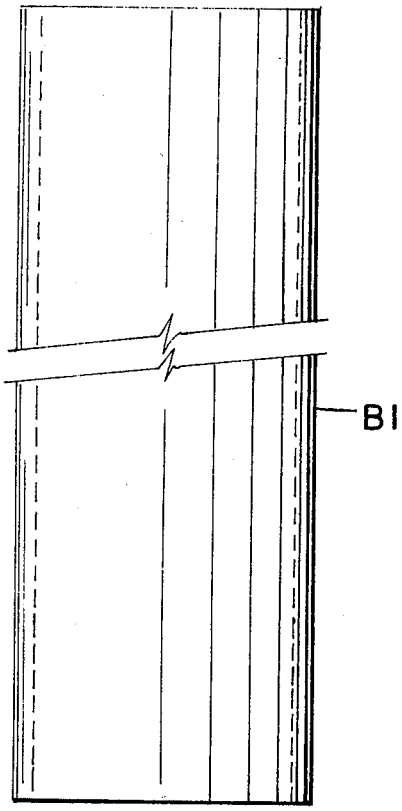
Figure 12:
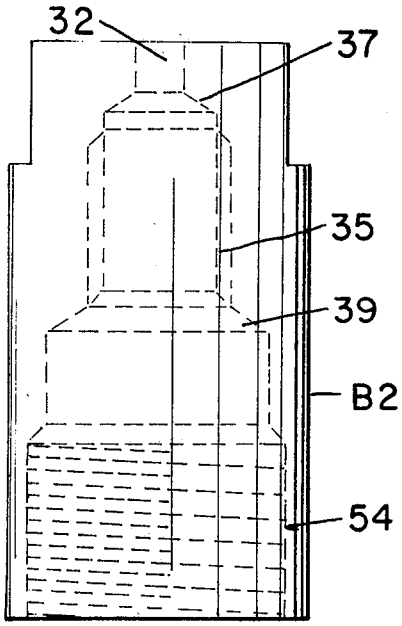
Figure 14:
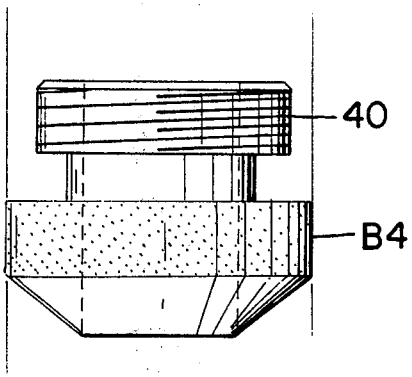
Figure 13:
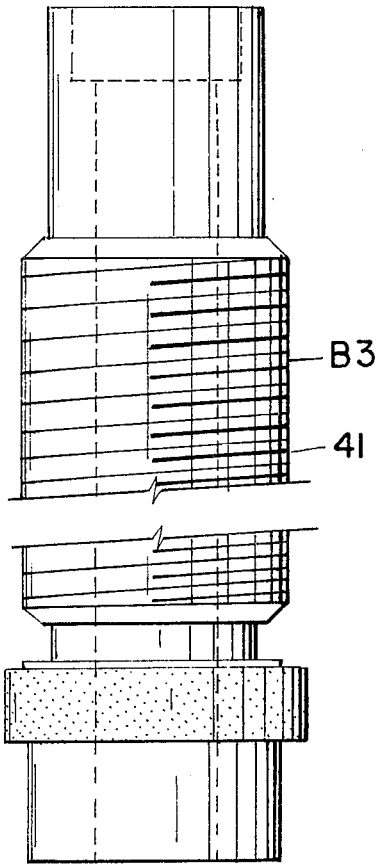
Figure 15:
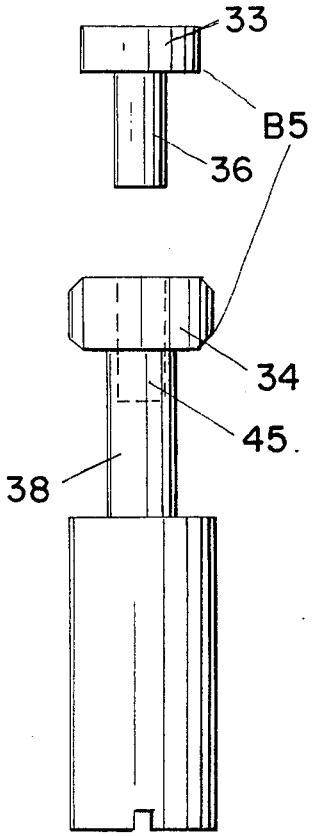
Figure 16:
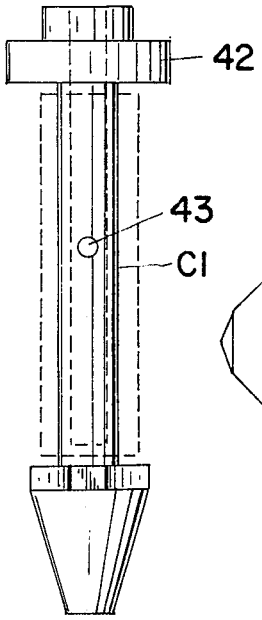
Figure 18:
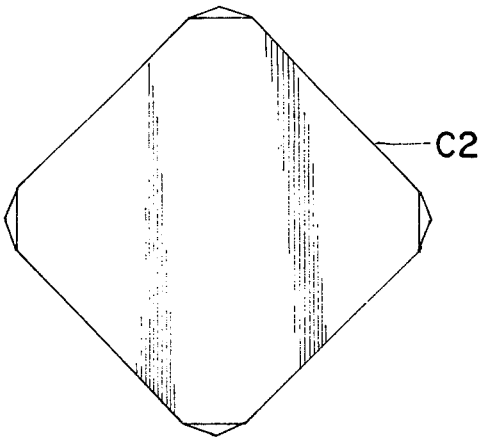
Figure 17:
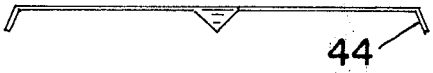

| FIG. 3 – FIG. 18 | NAME OF PART | LABEL OF PART |
|---|---|---|
| FIG. 8 | Inertia spring | A6 |
| FIG. 9 | Inertia guide rod | A7 |
| FIG. 10 | Striker | A8 |
| FIG. 11 | Sample chamber | B1 |
| FIG. 12 | Bleed valve seat | B2 |
| FIG. 13 | Non-return valve seat | B3 |
| FIG. 14 | Bleed valve cap | B4 |
| FIG. 15 | Bleed valve stem | B5 |
| FIG. 16 | Non-return valve core and sleeve | C1 |
| FIG. 17 | Frangible seal (shim) Side View | C2 |
| FIG. 18 | Frangible seal (shim) | C2 |

Figure 19:
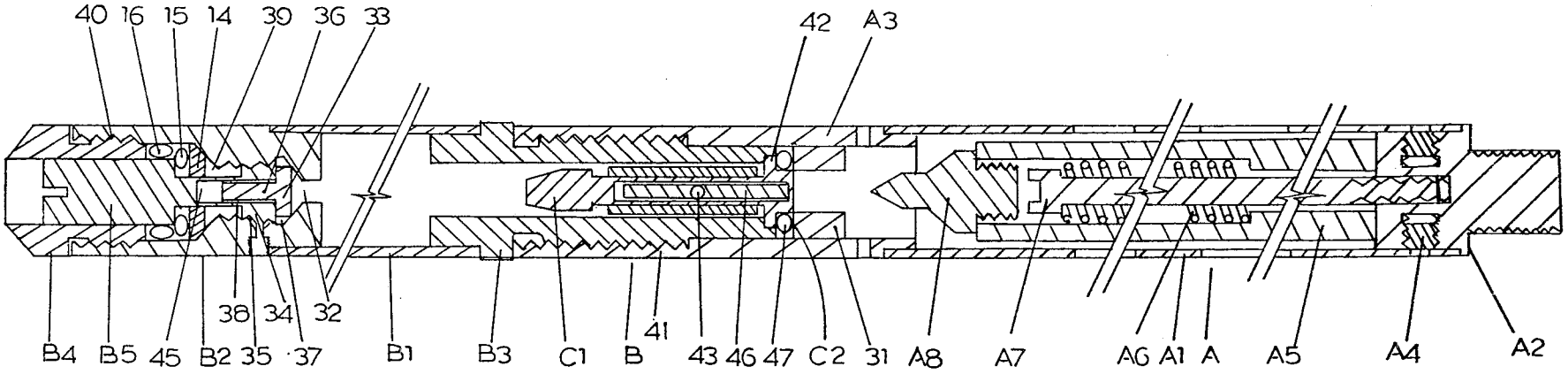

FIG. 19 is a cross-section of the vessel shown in FIG. 2.

Because of its proportions, the larger sampling vessel shows the relation of its components more readily than does the smaller vessel. FIG. 1 will therefore be used to show the general pattern of both of the vessels before details of construction are given related to the smaller vessel.

FIG. 1 shows in section a generally cylindrical form 7. The component parts are in the main machined from Austenitic Stainless Steel, Argon - arc welded. Springs 4 and 12 are of spring steel which corrodes more readily than does stainless steel but which has a better resilience and is easy and cheap to replace. Minor amounts of copper - brass - neoprene, fluorocarbon elastomer and borosilicate glass are used.

The scale of the drawing is distorted as will be seen from the breaks in it. As has already been stated, the actual diameter is 50 mm and the actual length is 1.8 m.

The vessel is supported on a wire by a D or loop 20. Below this is a chamber 23 containing an inertia weight 3 supported by a spring. At the bottom of the inertial weight 3 is a striker 6 which in its rest position clears, by a distance enough to ensure against accidental operation, a frangible seal 8, which seals, with O-ring 9, a small hole into the actual vessel 21. In the path between the frangible seal and the vessel is a filter 10 and an elastically loaded non-return valve 6. The stem or stems 27 of this valve slide in guides 22 and are triangular in cross-section so as not to block the flow of fluid. At the bottom of the vessel is a bleed valve 17 for relieving the air lock when emptying out fluids that have been collected.

If the sampling vessel is jerked in the line of its axis, as for instance by jerking the wire by which it is suspended, the inertia weight 3 will bounce up and down on its spring 4 with reference to the main structure of the vessel. In this bouncing the striker will break the frangible seal 8. The cavity 23 which holds the striker 6 is pierced by many holes so that the fluid in which the vessel is immersed is in immediate contact with the frangible seal 8. As soon as this is broken, the surrounding fluid flows into the sample vessel.

The whole device is shackled to the suspension wire of a well measurement winch, such as the Mathey winch, which is fitted with a depth indicator. The bottle is lowered into a recovery tube at the top of the bore hole, the suspension wire passing through a threaded gland which screws on the top of the recovery tube and ensures effective sealing. When the winch indicates the depth at which the sample is required, the suspension wire is jerked so that the frangible seal 8 is broken and fluid flows into the vessel proper 21. When the interior pressure, together with the spring 12 pressure equals the exterior pressure, the non-return valve C closes and remains closed while the vessel is withdrawn. On the surface the vessel is cooled to prevent the sample, now at a pressure considerably above that of the atmosphere, from boiling when the bleed valve 17 is opened for sample recovery. Both patterns of vessel are capable of holding a vacuum when prepared for sampling. The smaller vessel, designed to be used in shallow wells where the pressure at working depth will not greatly exceed that of the atmosphere, needs to be evacuated for effective use. Because either vessel can be evacuated, samples may be collected without contamination by atmospheric air. Reliable gas samples have been collected.

The general description given so far applies explicitly to the larger sampling vessel and in general terms to the smaller one. Details now to be given apply explicitly to the smaller vessel but their application and where necessary adaptation to the larger vessel are considered to be obvious and not a matter of separate invention.

The middle line of FIG. 2 is an outline drawing of the smaller vessel, almost completely assembled. It has already been stated that its length (subject in some circumstances to an increase) is 573 mm and its outside diameter 12.7 mm. Numbers of constructional differences between FIG. 1 and subsequent figures are due to arrangements that are needed to put coaxial components within this relatively small diameter. The vessel has two main parts, A, open to the surrounding fluid and containing the inertia mechanism and striker, and B, containing the sample vessel proper, a frangible seal, a non-return valve and a bleed valve. The parts that are shown bear labels which refer to the subsequent detailed drawings.

FIG. 3 shows the upper barrel. It is of stainless steel 10.7 mm bore and 12.7 mm outside diameter. It is well ventilated. The exact manner of doing this is unimportant, but it has been found convenient to drill four 8 mm holes symmetrically disposed, in each 20 mm length of the tube. The overall length of the tube is 130 mm. To the top is affixed part A2 shown in FIG. 4. This is a plug held into the end of part A1 by two grub screws A4. So that they shall not be lost, they are arranged in an unusual fashion. One is shown in FIG. 6. It is made from a ⅛ inch Whit. Allen screw by turning down the head to a diameter of 2.5 mm over a length of 1 mm. In the lower end of part A2 are two blind holes to receive the grub screws. The overall length of the grub screw, 3 mm, is such that it can be completely buried in the blind hole in part A2. In part A1 are two holes to mate with the two holes in part A2. They are clearance holes for 2.5 mm so that when part A1 and A2 are put together with the grub screws in place, the grub screws are effectively captive. They are tightened by running them outwards and part A2 is released from part A1 by running them into the cavities in part A2. Centrally in the lower part of part A2 is an axial hole to take the screwed end of the inertia guide rod shown on FIG. 9. The upper part of part A2, that part which is exposed when part A1 and A2 are assembled, is solid, and carries a thread to mate with any convenient D or loop for taking the suspension wire. Part A3 is welded, brazed or otherwise permanently affixed at the lower end of part A1. Its lower end carries a thread to mate with part B3. The external diameter is 12.7 mm and the bore is 9.5 mm. The overall length is 38 mm of which 15 mm is taken up by the thread already referred to.

The purpose of part A3 is to provide a shoulder 31 for holding shim and O-ring to be referred to later. This shoulder is welded into the tube so that its lower edge is 8 mm from the lower end of part A1. The axial length of the shoulder is not significant, but can conveniently be 5 mm. The shoulder has a bore of 4 mm. It is marked as 31 in FIG. 5. Part of the lower end of A3 may conveniently be knurled. FIG. 7 shows the inertia weight A5. It is 9.5 mm outside diameter so as to slide freely within part A1 and is 100 mm long overall. The weight is hollow and the bottom 5 mm is tapped (conveniently ¼ inch UNF) to take the striker A8 shown on FIG. 10. For 30 mm above the tapped portion, the weight is bored out to 5 mm to take helical spring A6 which is shown on FIG. 8. This is 20 mm long and has an outside diameter of 5 mm. It is formed from ½ mm spring steel wire and has 15 to 16 coils to give a rate of 200 g/cm. The remainder of the weight is bored to 3 mm to take inertia guide rod A7, a rod 102 mm long and 2.6 mm in diameter, screwed into part A2. The rod can conveniently be made of stainless steel welding rod 3/32 inch diameter, to which is brazed a head with a screw-driver slot. FIG. 10 shows the striker A8 which screws into the bottom of part A5. Below the screwed part is a short length of greater diameter to form a shoulder and also to provide flats on which a spanner can be used. Below this, the diameter is brought down in any convenient profile over a length of 15 mm to a conical point which must be sharp. FIG. 11 shows the sample chamber B1 10.7 mm bore and 12.7 mm outer diameter. For boreholes in general it can be about 400 mm long, but this length can be extended if the bore-hole is straight and vertical.

FIG. 12 shows a bleed valve seat B2 which is brazed, welded or otherwise permanently fixed in the foot of part B1. This is the seat for the seal which is shown only schematically at 17 in FIG. 1. The seat is machined from stainless steel and may conveniently be of type 304. At the top is a hole 32 which communicates with the space within the sampling vessel proper. It can conveniently be 2 mm in diameter. Below it is a length 35 of 7 mm tapped to ¼ inch UNF. Between the two is a length of 37 of about ½ mm to provide a seat for PTFE seal 33 shown on FIG. 15. Below the ¼ inch tapped length, the bore is increased to provide a shoulder 39 for two O-rings and below that is an 8 mm length 54 tapped 7/16ths UNF. FIG. 14 shows a cap B4 to be screwed into the 7/16th tapped hole 54 in part B2. This cap does not form a seal, but puts pressure on the two O-rings to be described shortly. FIG. 15 shows the bleed valve B5 to fit inside part B2. At its head is a 3 mm length carrying a ¼ inch UNF thread 34 to mate with the thread 35 of part B2. Within the head of the stem is a 2 mm bore 5 mm deep blind hole 45 to take the stem 36 of PTFE seal 33 which is compressed by thread 34 against seat 37 in part B2. Below the thread 34 the stem is turned down at 38 to carry a packer shown as 14 on FIG. 2 and two O-rings shown on the same figure as 15 and 16. The O-rings are compressed against shoulder 39 by the screw thread 40 of cap B4.

At the top of sampling vessel tube B1 is brazed, welded or otherwise permanently affixed a seating B3 shown in FIG. 13, for the non-return valve C1 and the frangible seal C2 of the sample containing vessel B1. This is threaded at 41 to mate with the lower end of part A3 and is bored to take valve core and sleeve C1 shown in FIG. 16. This requires a hole 5 mm in diameter counter-bored at the top to 7 mm to take head 42. The external surface of the seat, below the threaded portion, can conveniently be knurled.

Stem C1 shown in FIG. 16 has at its bottom a head for location, triangular in cross-section to give free passage to fluids and tapered. From the top an axial 1.5 mm hole is drilled for approximately 18 mm to take a filter 46 consisting of a rectangle 15 × 8 mm of 177 μm to 250 μm stainless steel mesh rolled lengthwise into a tube 1 mm to 1.5 mm in diameter. The seal sits on O-ring 47. The stem is drilled 43 crosswise so that the blind hole may communicate with the stem's surroundings. This arrangement is caused to be a non-return valve by a rubber sleeve over the stem at the cross-hole 43. Above the shoulder formed by the expanded portion 42 is fitted an O-ring. The length of part A3 is carefully adjusted so that when parts A3 and B3 are screwed together the O-ring is compressed on shoulder 31 shown in FIG. 5. Between the O-ring and shoulder 31 is a shim seal C2 shown in FIG. 17. It can be made of any metal but steel stock 0.1 mm thick has been found convenient. To locate it the four corners are bent down by tweezers as shown at 44.

The small sampling vessel as now described is normally used in shallow wells where the hydrostatic pressure is insufficient to fill the vessel against atmospheric pressure and the non-return valve resistance. It is therefore normally evacuated before use.

The larger vessel of FIG. 1 will not be described in detail, since it is only a matter of competent workmanship to transfer the details from the vessel of FIG. 2 to that of FIG. 1. Possible exceptions to this are the filter 10 which consists of a disc of 177 μm to 250 μm mesh stainless steel supported by a similar 500 μm disc. The biggest difference of the patterns as shown is in the frangible seal. In FIG. 1 this is a tube 8 of borosilicate glass supported in a gland formed by O-rings. This is satisfactory in use but the shim seal shown on FIG. 17 is to be preferred. It is more convenient in use than the glass tube and has been found to be satisfactory at pressures up to 137 atm. to seal a hole 3 mm in diameter. This seal will replace the glass seal in the future manufacture of the larger bottle.

What I claim is:

1. A sampling vessel adapted for lowering into bodies of fluid selected from a liquid, a gas and a mixture of liquid and gas comprising in combination a fluid container fitted with a non-return valve adapted to be closed and to be held closed by the pressure of the sample collected, a frangible seal in the form of a glass tube, a continuous elastic backing maintained in compression between the vessel and the frangible seal and a seal-breaking device comprising a striker attached to a weight suspended by a spring from a point within the vessel and adapted to be moved by inertial forces from a rest position remote from the seal to a position at which it breaks the seal, wherein the distance of the striker in its rest position and the strength of the spring prevent accidental breaking of the seal by normal handling at the surface and in the bore.

2. A vessel as claimed in claim 1 wherein the inertial mechanism is adapted to be activated by jerking the means by which the vessel is suspended.

3. A sampling vessel as claimed in claim 1 when constructed of such materials and in such a configuration as to withstand corrosive fluids at high temperatures and pressures.

* * * * *